US005587781A

United States Patent [19]

Auty et al.

[11] Patent Number: 5,587,781

[45] Date of Patent: Dec. 24, 1996

[54] OPTIMIZING ELECTROSTATIC BRUSH INTERFERENCES FOR INCREASED DETONING EFFICIENCY

[75] Inventors: Ronald E. Auty, Rochester; Dennis G. Gerbasi, Webster, both of N.Y.

[73] Assignee: Xerox Corporation, Stamford, Conn.

[21] Appl. No.: 566,098

[22] Filed: Dec. 1, 1995

[51] Int. Cl.[6] ..... G03G 21/00

[52] U.S. Cl. ..... 355/301; 355/302; 15/256.52

[58] Field of Search ..... 355/301, 302, 355/303, 304, 297; 15/256.5, 256.51, 256.52

[56] References Cited

U.S. PATENT DOCUMENTS

| | | | |
|---|---|---|---|
| 4,134,673 | 1/1979 | Fisher | 355/15 |
| 5,212,530 | 5/1993 | Harada et al. | 355/301 |
| 5,229,817 | 7/1993 | Lange et al. | 355/301 X |
| 5,329,344 | 7/1994 | Gerbasi et al. | 355/301 |
| 5,341,201 | 8/1994 | Kedarnath et al. | 355/302 |
| 5,450,186 | 9/1995 | Lundy | 355/301 |
| 5,479,249 | 12/1995 | Jugle et al. | 355/301 |
| 5,493,383 | 2/1996 | Pozniakas et al. | 355/301 |
| 5,512,995 | 4/1996 | Gerbasi | 355/302 X |

*Primary Examiner*—R. L. Moses
*Attorney, Agent, or Firm*—T. L. Fair

[57] ABSTRACT

An apparatus is disclosed that includes an electrostatic brush cleaner that optimizes the brush interference with the imaging surface and the detoning roll for increased detoning efficiency. The brush-to-detoning roll interference is always kept greater than the brush-to-imaging surface interference for increased detoning efficiency.

11 Claims, 4 Drawing Sheets

BDI<BPI

BDI=BPI

BDI>BPI

OPTIMIZING ELECTROSTATIC BRUSH INTERFERENCES FOR INCREASED DETONING EFFICIENCY

BACKGROUND OF THE INVENTION

This invention relates generally to an electrophotographic printer or copier, and more particularly concerns increasing detoning efficiency of the cleaner. Electrostatic brush detoning roll cleaners operate by removing the toner from the photoreceptor both with mechanical and electrostatic forces. The fibers on the brush contact the untransferred toner and the toner is removed from the photoreceptor onto the brush. The toner on the brush is then transported onto a detoning roll and the brush is detoned. The toner is attracted to both the brush and detoning roll due to the bias on these cleaning elements. If the detoning of the brush by the detoning roll is not 100% effective, the brush will accumulate with toner eventually leading to toner emissions and cleaning failures.

The following disclosures may be relevant to various aspects of the present invention and may be briefly summarized as follows:

U.S. Pat. No. 5,341,201 to Kedarnath et al. discloses an apparatus for detoning a cleaner brush by providing multiple opportunities for fiber detoning to take place. A screen detoning element located in the cleaner housing causes multiple interferences with the brush fibers bringing about a high degree of detoning of the cleaner brush.

U.S. Pat. No. 4,134,673 to Fisher discloses the cleaning apparatus comprises a first cleaning brush arranged for brushing engagement with the imaging surface and a second cleaning brush arranged for brushing engagement with the imaging surface following the first cleaning brush. The first cleaning brush has a first brush to imaging surface interference. The second brush has a second brush to imaging surface interference which is greater than the first interference. In accordance with preferred embodiments the first interference has a magnitude of from about 20% to about 80% of the second interference.

SUMMARY OF INVENTION

Briefly stated, and in accordance with one aspect of the present invention, there is provided an apparatus for removing particles from an imaging surface, comprising means for cleaning particles from the imaging surface, the removing means and the surface having a first interference therebetween; and means for removing particles from the cleaning means, the cleaning means and the removing means having a second interference therebetween, the second interference being greater than the first interference.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 4:
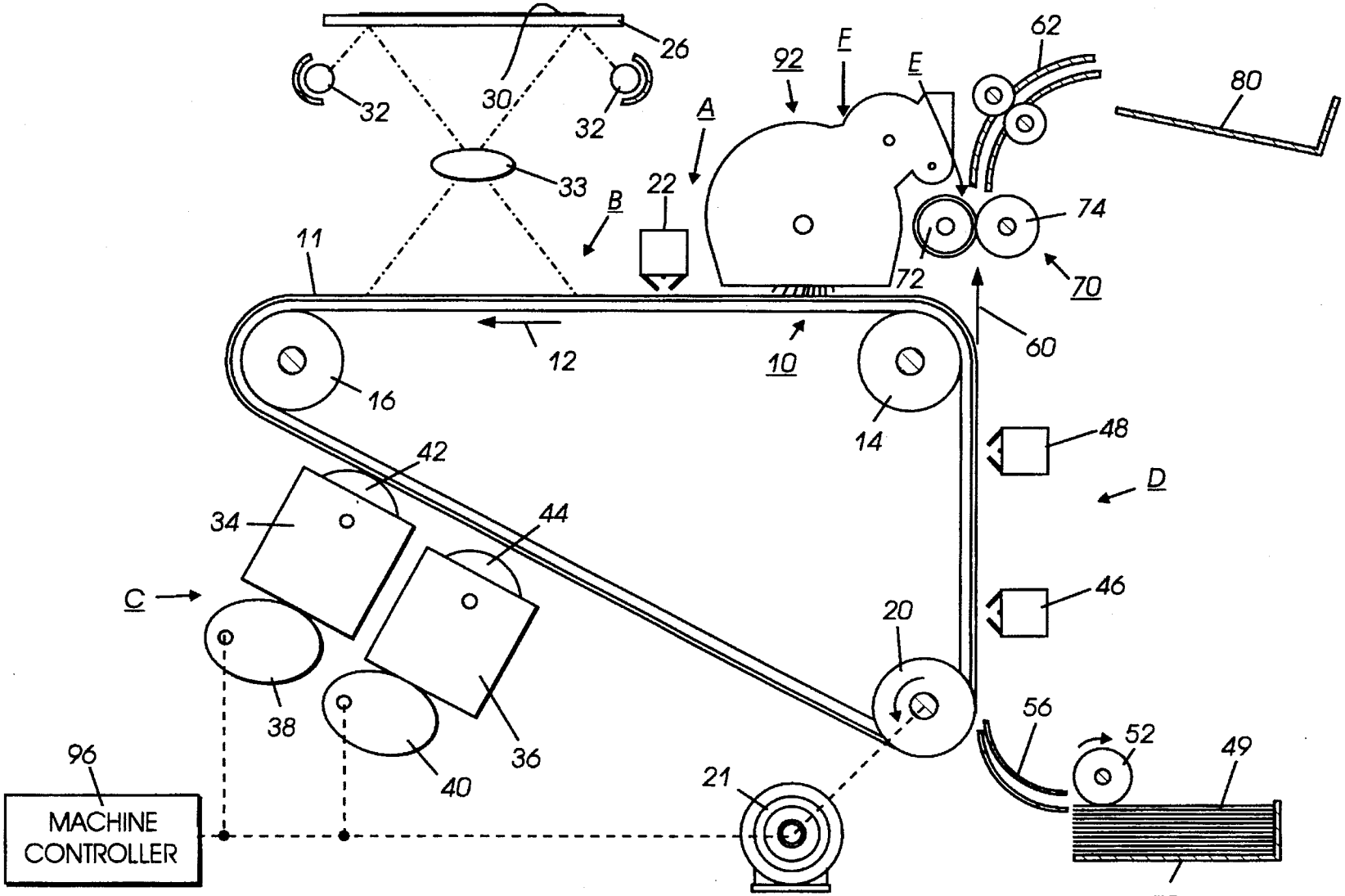
FIG. 4 is a schematic illustration of a printing apparatus incorporating the inventive features of the present invention.

For a general understanding of an electrophotographic printer or copier in which the present invention may be incorporated, reference is made to FIG. 4, which depicts schematically the various components, thereof. Hereinafter, like reference numerals will be employed throughout to designate identical elements. Although the roll-detoned cleaner brush apparatus of the present invention is particularly well adapted for use in an electrophotographic printing machine, it should become evident from the following discussion, that it is equally well suited for use in other applications and is not necessarily limited to the particular embodiment shown herein.

Referring now to the drawings, the various processing stations employed in the reproduction machine illustrated in FIG. 4, will be described briefly hereinafter. It will no doubt be appreciated that the various processing elements also find advantageous use in electrophotographic printing applications from an electronically stored original, and with appropriate modifications, to an ion which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance excessive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 4, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to develop station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60 to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, are removed at cleaning station F. The cleaning apparatus of the present invention is represented by the reference numeral 92 which will be described in greater detail in FIGS. 1 and 2. Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection diagnostic operations to a user interface (not shown) where required.

Electrostatic brush detoning roll cleaners operate by removing the toner from the photoreceptor both with mechanical and electrostatic forces. The fibers on the brush contact the untransferred toner and the toner is removed from the photoreceptor onto the brush. The toner on the brush is then transported onto a detoning roll and the brush is detoned. The toner is attracted to both the brush and detoning roll due to the bias on these cleaning elements. If the detoning of the brush by the detoning roll is not 100% effective, the brush will accumulate with toner eventually leading to toner emissions and cleaning failures. The present invention increases the detoning efficiency of the cleaning brush.

Figure 1:
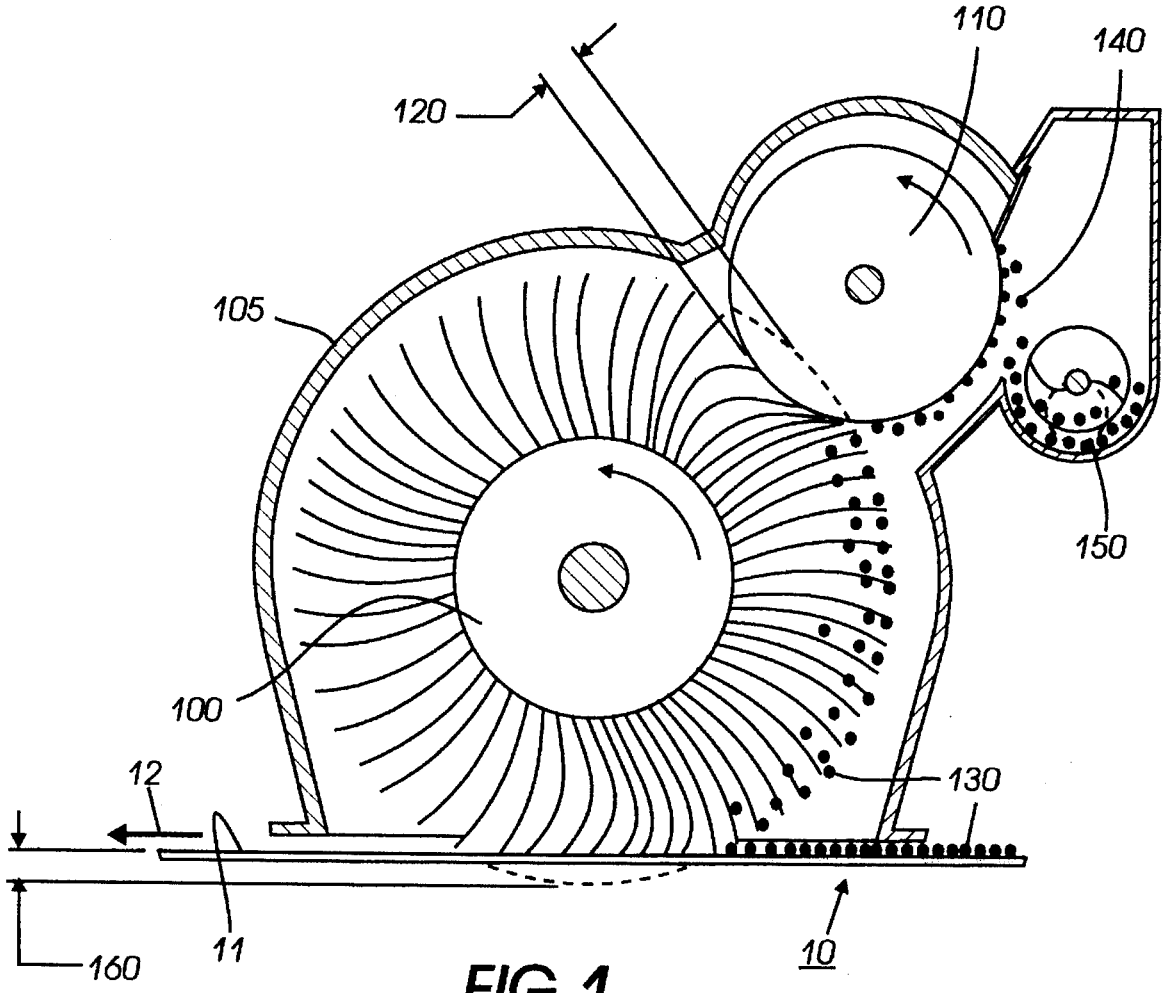
FIG. 1 is an elevational schematic illustration of a brush cleaner and interference parameters of the present invention.

Reference is now made to FIG. 1 which shows a schematic illustration of the cleaner and interference parameters of the present invention. The brush 100 to detoning roll 110 interference 120 is shown to be greater than the brush 100 to photoreceptor 10 interference 160. (i.e. Interference can be defined as the length of the brush fibers 105 that would exist past the surface being interfered with if the fibers were to remain straight at the longest length rather than bend to the contacting member.) This brush-to-photoreceptor interference (BPI) to brush-to-detoning roll interference (BDI) relationship of the present invention, increases the detoning efficiency of the brush. The toner particles 130 are removed from the surface 11 by the fibers 105 of the cleaner brush 100. The toner particles 130 form a match head configuration (see FIG. 2A) on the brush fibers 105 as they are removed from the surface. The cleaner brush 100 is detoned of toner particles 130 by the detoning roll 110. The toner particles 130 are removed from the cleaner brush 100 by mechanical and/or electrostatic attraction. The toner particles 130 adhere to the surface of the detoning roll 110 and are removed from the detoning roll 110 by the scraper blade 140. The scraper blade 140 guides the toner particles 130 into a waste container 150.

In developing the present invention, experimentation was conducted to study the effects of various critical parameters on brush detoning. These parameters included: the brush-to-detone roll interference(BDI), the brush-to-photoreceptor interference (BPI), the brush pile height (PH), the brush weave density (WD) and brush speed (RPM). Each of the parameters had a high and low value that was tested. Upon completion of the experiment, it was determined by graphing the effects of the critical parameters that the two interferences (BDI and BPI) were the key drivers for brush detoning. The other parameters tested had little or no effect on brush detoning.

Figure 2A:
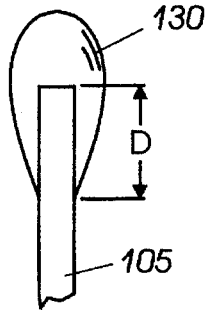
FIGS. 2A is a schematic of toner in a match head configuration on a brush fiber.

Reference is now made to FIGS. 2A–2D which show the effects on brush detoning as a function of the brush-to-detone roll interference (BDI) and the brush-to-photoreceptor interference (BPI). In FIGS. 2A–2D, a brush fiber 105 is shown. In FIG. 2A, the brush fiber 105 is shown with a match head configuration of toner 130 on the tip of the brush fiber 105 that remains after the brush fiber 105 cleans the photoreceptor surface. The distance, d, of the toner 130 from the brush fiber tip toward the core of the cleaning brush is determined by the BPI. The greater the interference between the brush and the photoreceptor during cleaning, the greater the match head length, d, of toner 130 along the brush fiber 105 (i.e. the toner and other debris particles are embedded further along the brush fibers toward the brush core when the BPI is increased). Since the match head length increases with higher BPI, the BDI must be increased to effectively detone more of the brush fiber. Hence, the BDI needs to be greater than the BPI, as in the present invention, for increased detoning efficiency.

Figure 2B:
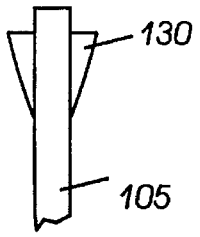
FIG. 2B is schematic view of a fiber where BDI is less then BPI.
Figure 2C:
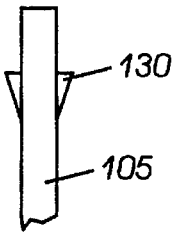
FIG. 2C is a schematic view of a fiber where BDI=BPI.

FIG. 2B shows a schematic view of a fiber where BDI is less than BPI. As shown, toner 130 is still present along the brush fiber 105 after detoning the brush. In comparison, FIG. 2C shows a schematic view of a brush fiber where the BDI is equal to the BPI. The amount of toner 130 remaining from the match head configuration, after detoning, along the brush fiber 105, is less than that remaining when the BPI is greater than the BDI (see FIG. 2B). FIG. 2C indicates the most commonly used proportional relationship of BDI to BPI.

Figure 2D:
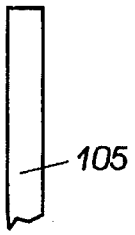
FIG. 2D is a schematic view of a fiber where BDI is greater than BPI, as in the present invention.

Reference is now made to FIG. 2D, which shows a schematic view of a detoned brush fiber when BDI is greater than BPI, as in the present invention. As shown, the brush fiber 105 has approximately 100% detoning efficiency. The BDI is greater than the BPI providing approximately 100% detoning efficiency.

Figure 3:
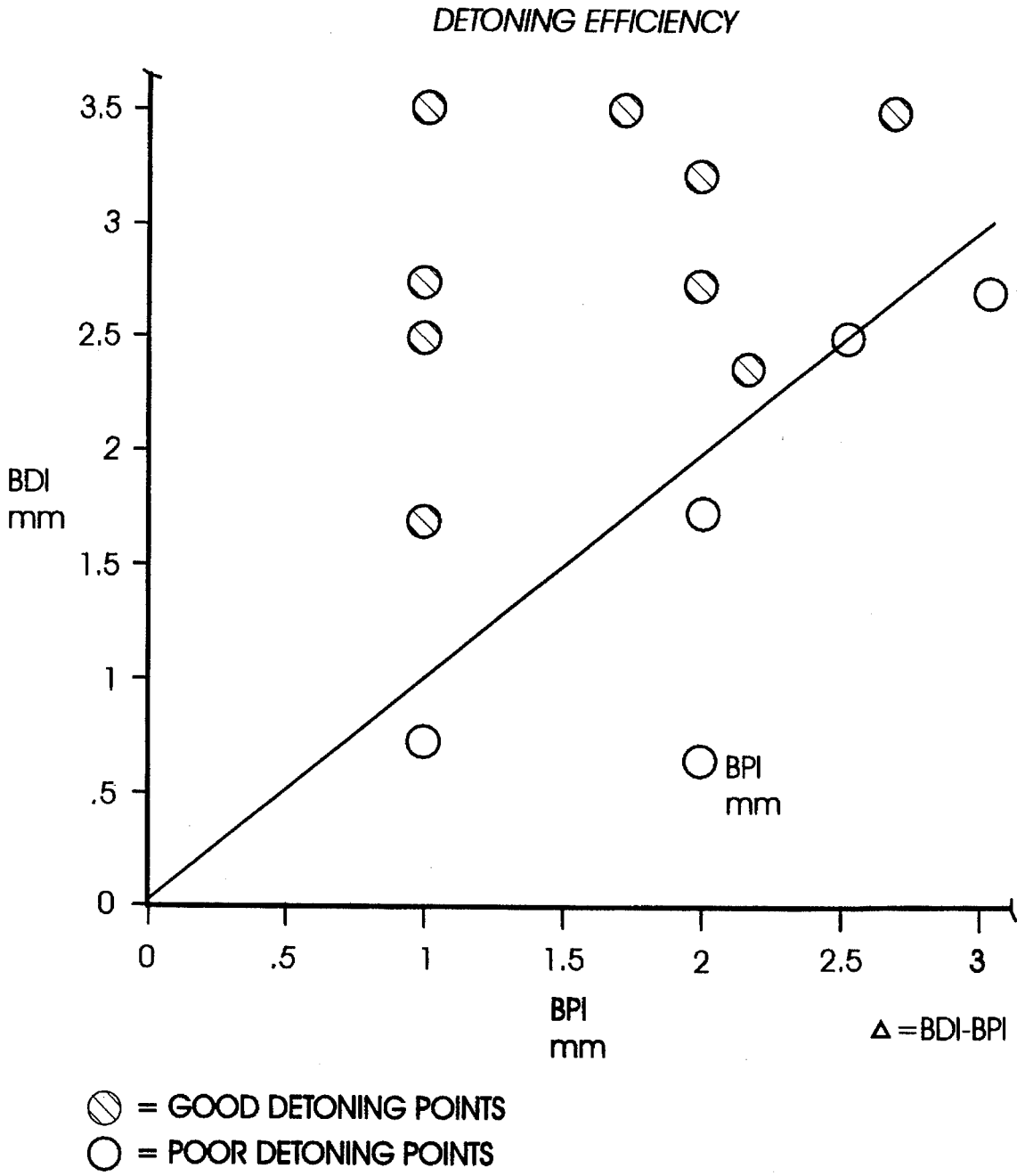
FIG. 3 is a graphical depiction of the detoning efficiency as a function of BPI and BDI.

Reference is now made to FIG. 3, which illustrates graphically the experimental data, of detoning efficiency, as a function of BPI and BDI, of the present invention. The diagonal line of the graph represents where the BPI and the BDI are equivalent. (See FIG. 2C for a schematic representation of detoning efficiency when BPI=BDI.) This equivalency ratio of BPI to BDI is the detoning efficiency commonly implored in the past in electrostatographic copiers and/or printers.

In the present invention, the brush-to-detoning roll interference is always higher than the brush-to-photoreceptor interference for an electrostatic brush detoning roll cleaner. This relationship of interference has been experimentally shown to significantly improve brush detoning efficiency. To maximize brush detoning efficiency in a cleaner, the manufacturing tolerances must be taken into account such that the BDI is always greater than the BPI. For example, a cleaner may have a nominal BPI of 2.0±0.5 mm. In order to have a BDI that is greater than the BPI, the BDI must always be greater than about 2.5 mm. If the tolerance for the BDI is 0.25 mm, the nominal BDI must be greater than 2.75 mm. Too high of a BDI will result in decreased brush life which must be considered when choosing a BDI. In the present invention, the preferred embodiment value for BPI ranges from 1 mm to 5 mm with a nominal preferred embodiment value of 2 mm. The preferred embodiment value for BDI ranges from 1 mm to 6 mm with a nominal preferred embodiment value of 3 mm.

With continuing reference to FIG. 3, the BPI shown ranges from 1.0 to 3.0 mm. The low limit of 0.75 mm was chosen because this corresponded with the BPI of 1.0 mm which gave a delta of –0.25 (i.e., the delta is defined as BDI minus BPI). It is noted that the detoning efficiency significantly increases once the delta turns from negative to positive.

Further referencing FIG. 3, the values represented by the hatch-marked data point circles represent the present invention. These data points represent increased detoning efficiency when BDI is greater than BPI (see FIG. 2D for a schematic representation of detoning efficiency when BDI is greater than BPI). As shown in the graph of FIG. 3, all of the hatch-marked data point circles, representing greater BDI than BPI, are located above the diagonal line representing BDI to BPI equivalency. BDI values less than or equal to BPI are represented by the unhatch-marked data point circles shown below the diagonal BPI/BDI equivalency line. This graphical illustration shows that when BDI is equal to or less than BPI, brush detoning significantly decreases (see FIGS. 2B and 2C).

A higher detoning interference than cleaning interference can be expanded to other brush detoning devices. Flicker bars, ramped flicker bars, combs, Velcro™, etc. should all have higher detoning interference than cleaning interference such that the toner does not migrate up the fiber far enough that the detoning mechanism cannot reach the toner. With the correct detoning interference, the brush will have less toner accumulation which yields less toner emissions, better cleaning, and longer brush life.

In recapitulation, the electrostatic brush cleaner of the present invention optimizes the brush interference with the imaging surface and the detoning roll for increased detoning efficiency. The brush-to-detoning roll interference is always kept greater than the brush-to-imaging surface interference for increased detoning efficiency. In the present invention, the preferred embodiment value for BPI ranges from 1 mm to 5 mm with a nominal preferred embodiment value of 2 mm. The preferred embodiment value for BDI ranges from 1 mm to 6 mm with a nominal preferred embodiment value of 3 mm.

It is, therefore, apparent that there has been provided in accordance with the present invention, an electrostatic brush cleaner that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing particles from an imaging surface, comprising:

means for cleaning particles from the imaging surface, said removing means and the surface having a first interference therebetween; and means for removing particles from said cleaning means, said cleaning means and said removing means having a second interference therebetween, the second interference being greater than the first interference.

2. An apparatus as recited in claim 1, wherein said cleaning means comprises a brush.

3. An apparatus as recited in claim 2, wherein said brush comprises:

a core; and a plurality of fibers extending outwardly from said core.

4. An apparatus as recited in claim 2, wherein said brush being electrostatic.

5. An apparatus as recited in claim 3, wherein said removing means comprises a detoning member.

6. An apparatus as recited in claim 5, wherein said removing means comprises a detoning roll.

7. An apparatus as recited in claim 6, wherein the first interference occurring where the fibers of said brush contact the imaging surface forming a cleaning nip.

8. An apparatus as recited in claim 7, wherein the second interference comprising the fibers of said brush in contact with the detoning roll forming a detoning nip.

9. An apparatus as recited in claim 8, wherein the first interference between the fibers and the surface ranges from 1 mm to 5 mm.

10. An apparatus as recited in claim 9, wherein the second interference between the fibers and the detoning roll ranges from 1 mm to 6 mm.

11. An apparatus as recited in claim 10, wherein said brush being positioned between said detoning roll and the imaging surface.

* * * * *

UNITED STATES PATENT AND TRADEMARK OFFICE

CERTIFICATE OF CORRECTION

PATENT NO. : 5,587,781
DATED : December 1, 1995
INVENTOR(S) : Ronald E. Auty et al.

It is certified that error appears in the above-identified patent and that said Letters Patent is hereby corrected as shown below:

Column 6,
Line 28, please delete "removing" and insert -- cleaning -- in place thereof.

Signed and Sealed this

Twelfth Day of October, 2004

JON W. DUDAS
*Director of the United States Patent and Trademark Office*